US006052945A

United States Patent [19]

Asada et al.

[11] Patent Number: 6,052,945

[45] **Date of Patent: *Apr. 25, 2000**

[54] METAL PLATE OF HIGH STRENGTH AND FLEXIBILITY

[75] Inventors: Sukekazu Asada, Chita-gun; Yukio Isomura, Anjo; Kazuhide Itagaki, Kariya; Hiroyuki Yamamoto, Toyota; Koichi Fujimoto, Kariya, all of Japan

[73] Assignee: Aisin Seiki Kabushiki Kaisha, Kariya, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/813,673

[22] Filed: Mar. 7, 1997

Related U.S. Application Data

[63] Continuation of application No. 08/497,601, Jun. 30, 1995, abandoned.

[30] Foreign Application Priority Data

Jul. 4, 1994 [JP] Japan ..... 6-151939
Apr. 28, 1995 [JP] Japan ..... 7-105876

[51] Int. Cl.[7] ..... E05F 11/44
[52] U.S. Cl. ..... 49/351; 49/374
[58] Field of Search ..... 49/374, 351, 350; 428/544, 595, 604; 74/379.2

[56] References Cited

U.S. PATENT DOCUMENTS

| | | | |
|---|---|---|---|
| Re. 7,198 | 7/1876 | Barker et al. | 428/604 |
| 2,441,476 | 5/1948 | Ewald | 428/604 |
| 4,044,186 | 8/1977 | Stangeland | 428/604 X |
| 4,221,079 | 9/1980 | Becker | 49/351 |
| 5,008,140 | 4/1991 | Schmertz | 428/604 X |
| 5,101,596 | 4/1992 | Moore | 49/351 |
| 5,255,470 | 10/1993 | Dupuy | 49/351 X |

FOREIGN PATENT DOCUMENTS

| | | |
|---|---|---|
| 871 958 | 7/1949 | Germany . |
| 43 37 678 A1 | 6/1994 | Germany . |

OTHER PUBLICATIONS

English Abstract of DE 43 37 678 A1.

Oehler. G., Die in Blech eingepragte Sicke als Versteifungselement, Konstruktion 22 (1970), 1st issue, pp. 5 to 9.

Official Letter dated Aug. 12, 1996 in corresponding German patent application.

English translation of official letter dated Aug. 12, 1996.

*Primary Examiner*—Daniel P. Stodola
*Assistant Examiner*—Curtis A. Cohen
*Attorney, Agent, or Firm*—Finnegan, Henderson, Farabow, Garrett & Dunner, L.L.P.

[57] ABSTRACT

A strong metal plate having flexibility includes a flat portion, a plurality of first protuberances projecting from the flat portion in one direction of the thickness direction of the flat portion and a plurality of second protuberances projecting from the flat portion in the other direction of the thickness.

12 Claims, 10 Drawing Sheets

METAL PLATE OF HIGH STRENGTH AND FLEXIBILITY

This application is a continuation of application Ser. No. 08/497,601, filed Jun. 30, 1995, now abandoned.

FIELD OF THE INVENTION

The present invention relates to a metal plate; and more particularly, to a metal plate of high strength and flexibility for use as a window regulator device of an automotive vehicle.

BACKGROUND OF THE INVENTION

A conventional metal plate having a high strength is disclosed in Japanese patent Laid-open publication No. 1 (1989)-172421 published without examination on Dec. 6, 1989. The metal plate has a flat portion, a plurality of first wave portions and a plurality of second wave portions.

The first wave portions extend in a direction parallel with each other. The second wave portions extend parallel to one another in the same direction as the first wave portions. The first wave portions and the second wave portions are disposed alternately.

The first wave portions have a plurality of equally spaced first mound portions projecting from the flat portion in the thickness direction. The first mound portions are surrounded by the flat portion.

The second wave portions have a plurality of equally spaced second mound portions projecting from the flat portion in the same direction as the first mound portions. The second mound portions are surrounded by the flat portion. Thus, the second wave portions have the same shape as the first wave portions, but are shifted in the extending direction by substantially ½ of a wave length.

In the above-described metal plate, the first and second mound portions project from the same side of the flat portion in the thickness direction. Although, the metal plate is stronger than a flat metal plate without wave portions, since only the first and second mound portions are formed on the flat portion, the stiffness of the metal plate is higher than the stiffness of a flat metal plate. Hence, deflection of the above metal plate is lower than the deflection of a flat metal plate.

If the metal plate is used for a lift arm of a window regulator connected to a window glass which moves in three dimension, the lift arm may not follow the three dimensional movement of the window glass when the window glass goes up and down due to low deflection of the metal plate. This causes the window glass to operate slower and noisier.

In light of the foregoing, there is a need for a flexible metal plate having a high strength, which addresses at least the foregoing drawback of the related art.

SUMMARY OF THE INVENTION

Accordingly the present invention is directed to a metal plate that substantially obviates one or more of the problems due to limitations and disadvantages of the related art.

To achieve these and other advantages and in accordance with the purpose of the invention, as embodied and broadly described, the invention includes a metal plate having a flat portion, a plurality of first protuberances projecting from one side of the flat portion in the thickness direction and a plurality of second protuberances projecting from the opposite side of the flat portion in the thickness direction. Thus, the strength thereof can be higher than the strength of a flat metal plate, and the flexibility can be greater than that of a conventional metal plate.

In another aspect, the invention is a window regulator device including an opening for a window glass formed in a door; a guide member supporting the window glass; driving means for driving the guide member in such a manner that the guide member goes up and down with three dimensional movement; a lift arm, connected to both the guide member and driving means, rotatably supported in the door; the lift arm being a metal plate having high strength and flexibility; and the metal plate comprising a flat portion, a first plurality of protuberances projecting from the flat portion in one direction of the thickness of the flat portion and a second plurality of protuberances projecting from the flat portion in the other direction of the thickness thereof.

The foregoing and additional features of the present invention will become more apparent from the following detailed description of preferred embodiments thereof when considered with reference to the attached drawings.

DETAILED DESCRIPTION OF THE PREFERRED EMBODIMENTS

Figure 6:
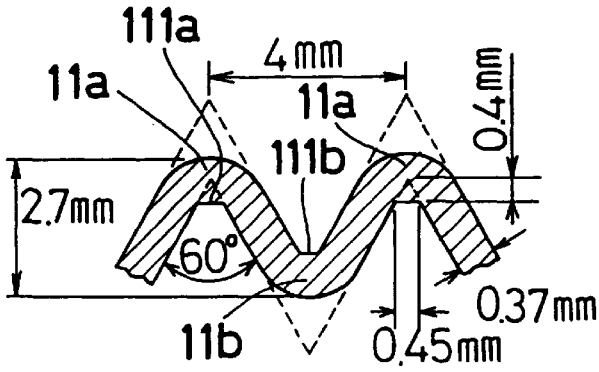
FIG. 6 is a magnified fragmentary view showing details of the configuration of the metal plate constructed according to the first embodiment of the present invention.

A metal plate of high strength and low stiffness in accordance with a first embodiment of the present invention is explained hereinafter with reference to FIG. 1 and FIG. 6.

Figure 1:
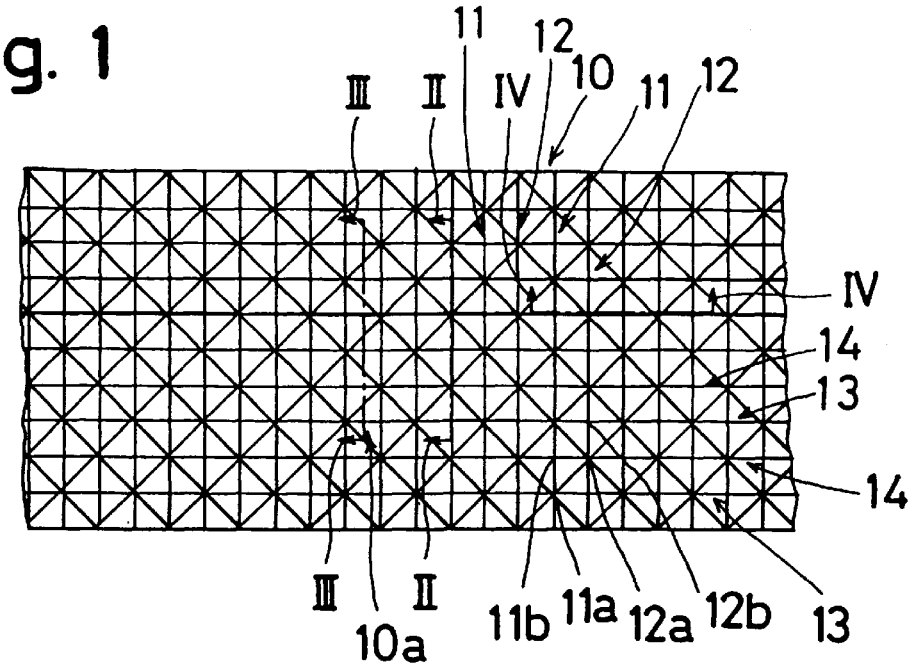
FIG. 1 is a plan view of a metal plate constructed according to a first embodiment of the present invention.

As herein embodied and referring to FIG. 1, a strong metal plate 10 having low stiffness, or, in other words, flexibility, includes a flat portion 10*a*, a plurality of first undulating or wave portions 11, a plurality of second undulating or wave portions 12, a plurality of third undulating or wave portions 13 and a plurality of fourth undulating or wave portions 14. In this embodiment, the metal plate 10 is formed from a cold rolled steel sheet (SCP440). The metal plate 10 may be formed from another sheet such as a hot rolled steel sheet, an aluminum sheet, or a copper sheet, for example.

The flat portion 10*a* corresponds to a flat metal plate 23 before forming (shown in FIG. 5) and is a reference face when forming.

The first wave portions 11 extend in the upward and downward direction in FIG. 1 parallel with each other. The second wave portions 12 extend in the same direction as the first wave portions 11 between the waveforms 11. Thus, the first and second wave portions 11,12 are disposed alternately relative to one another. The third wave portions 13 extend parallel to one another in a direction perpendicular to the longitudinal or extending direction of the first wave portions 11 (the right and left direction in FIG. 1) in parallel with each other. The fourth wave portions 14 are disposed between the wave portions 13 and extend longitudinally in the same direction as the third wave portions 13. Thus, the third and fourth undulating or wave portions 13, 14 are disposed alternately relative to one another.

Figure 2:
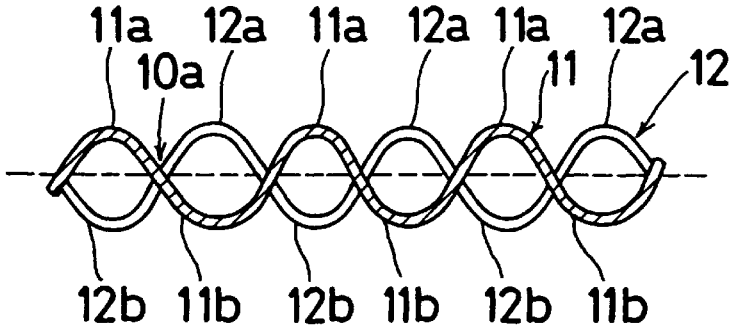
FIG. 2 is a magnified fragmentary cross-sectional view taken along the section line II—II in FIG. 1.

As shown in FIG. 2, the first wave portions 11 include a plurality of equally spaced first mound portions 11*a* and a plurality of equally spaced first cavity or valley portions 11*b*. The first mound portions 11*a* project from the flat portion 10*a* from one surface of the metal plate in the direction of the thickness or in other words perpendicular to the plane of the metal plate (the upward direction as viewed in FIG. 2). The first valley portions or cavities 11*b* project from the flat portion 10*a* in the other direction of the thickness (or the downward direction as viewed in FIG. 2). The first cavity portions 11*b* are connected to the two adjacent first mound portions 11*a*. The distance between the two adjacent first mound portions 11*a*, (hereinafter referred to as a pitch of the mound portions 11*a*) is as long as the distance between the two adjacent first cavity or valley portions 11*b*, (hereinafter referred to as a pitch of the first valley portions 11*b*).

As shown in FIG. 2, the second wave portion 12 has the same profile as that of the first wave portions 11. The second wave portions 12 are shifted relative to the first wave portions 11 in the left and right direction by substantially ½ of the wave length.

The second wave portions 12 include a plurality of equally spaced second mound portions 12*a* and a plurality of equally spaced second valley or cavity portions 12*b*. The second mound portions 12*a* project from the flat portion 10*a* and in the same direction as the first mound portions 11*a*. The distance between the two adjacent second mound portions 12*a*, (hereinafter referred to as a pitch of the second mound portions 12*a*) is equal to the pitch of the first mound portions 11*a*. The second cavity portions 12*b* project from the same surface of the flat portion 10*a* in the same direction as the first valley portions 11*b*. The distance between the two adjacent second valley portions 12*b*, (hereinafter referred to as a pitch of the second mound portions 12*b*) is equal to the pitch of the two adjacent first valley portions 11*b*.

Figure 3:
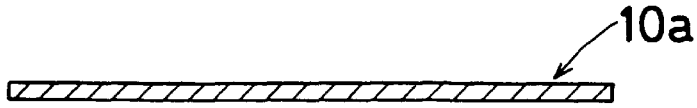
FIG. 3 is a magnified cross-sectional view taken along the section line III—III in FIG. 1.

As shown in FIG. 3, a shape of a vertical cross section of a center portion between the first and second wave portions 11 and 12 corresponds to the shape of a vertical section of the flat portion 10*a*. The center portion as shown in FIG. 3 is hardened by working and is thinner than the flat metal plate 23.

Figure 4:
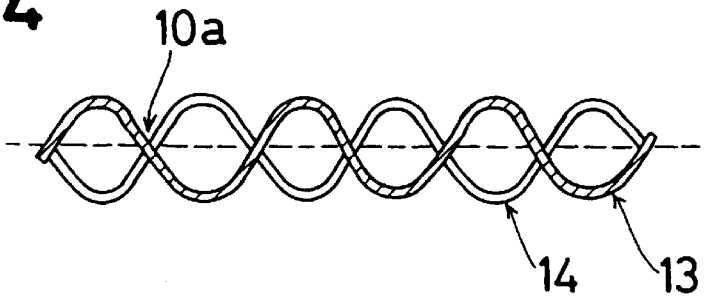
FIG. 4 is a magnified cross-sectional view taken along the section line IV—IV in FIG. 1.

As shown in FIG. 4, the third wave portions 13 have the same profile or shape as the first wave portion 11 and each fourth wave portion 14 has the same shape or profile as the first wave portion 11. The fourth wave portions 14 are shifted relative to the third wave portions 13 in the up and downward direction by substantially ½ of the wave length.

The shape of the first wave portions 11 is explained in detail with reference to FIG. 6. The thickness of the metal plate 10 at the first wave portion 11 is 0.37 mm. The pitch of the first wave portion 11 is 4 mm. An interior angle of 60 degrees is defined by the slopes of the first mound portion 11*a* of the first wave portion 11. The distance between the top portion of the first mound portion 11*a* and the bottom portion of the first valley portion 11*b* (hereinafter referred to as the height of the first wave portion 11) is 2.7 mm.

A flat face 111*a* is provided at a back face of a top portion of the first mound portion 11*a*. Also, a flat face 111*b* is provided at a surface of a bottom portion of the first valley portion 11*b*. A width of the flat faces 111*a*, 111*b* is 0.45 mm. A thickness of the flat metal plate before molding is 0.8 mm. The sizes of the second, third, and fourth wave portions 12, 13, and 14 of the first embodiment are each equal to the size of the first wave portion 11. When viewing the plate 10 from the other side, the flat face 111*a* is the bottom portion of a cavity or valley 11*b*, and the flat face 111*b* is the back face of the top portion of a mound 11*a*. Thus, the plate 10 has a plurality of equally spaced hollow protuberances extending from both surfaces of the metal plate 10. Thus, the metal plate 10 also has equally spaced cavities in opposite surfaces of the metal plate. Each hollow protuberance extending from one side of the plate is the cavity in the opposite side of the plate.

Figure 5:
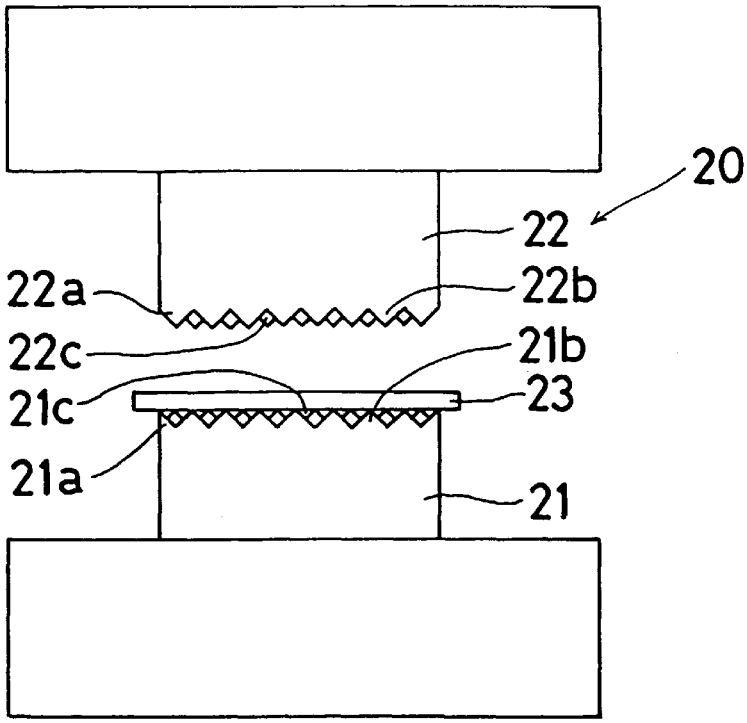
FIG. 5 is a front view of a press mold device for forming the metal plate according to the first embodiment of the present invention.

Hereinafter a die stamping method for forming the metal plate 10 is described with reference to FIG. 5. A press mold or die stamping machine 20 is used for forming the metal plate 10.

The press molding machine 20 includes a lower die 21 for forming the first and second valley portions 11*b*, 12*b*. The lower mold 21 has a molding portion 21*a* having a plurality of protruding portions 21*b* and a plurality of cavity or valley portions 21*c*. A top of the mound portion 21*b* is chamfered. The upper die 22 has a portion 22*a* with a plurality of mound portions 22*b* and a plurality of valley portions 22*c*. Each mound portion 22*b* opposes each valley portion 21*c* of the lower die 21, and each valley or cavity portion 22*c* opposes each mound portion 21*b* of the lower die 21. A top portion of each mound portion 22*b* is chamfered.

Initially, flat metal plate 23 having a thickness of 0.8 mm is placed on the forging portion 21 a of the lower die 21. Then, the upper die 22 is moved toward the flat metal plate 23, and the flat metal plate 23 is pressed once with a pressure of 80 tons. As the last step, the metal plate 10 is removed from the press or die stamping machine 20.

Figure 7:
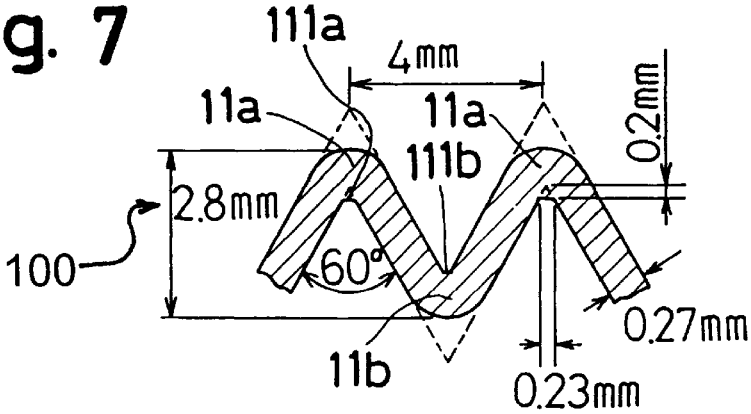
FIG. 7 is a magnified fragmentary view of a second embodiment of the present invention.

A metal plate 100, according to the second embodiment of the invention, has the same fundamental structure as the metal plate 10 of the first embodiment, but has dimensional details which differ from the metal plate 10 of the first embodiment. The details of the size of the metal plate of the second embodiment are explained with reference to the first wave portion 11 of FIG. 7. The configuration and dimensions of the second, third, fourth, and fifth wave portions of the second embodiment are the same as the first wave portions thereof.

Each first wave portion 11 of the second embodiment has a thickness of 0.27 mm. The pitch of the first wave portion 11 is 4 mm. An interior angle of 60 degrees is defined by the slopes of the first mound portion 11*a* of the first wave portion 11. Similarly, an angle of 60 degrees is defined by the slopes of the first cavity portion 11*b* of the first wave portion 11. The first wave portion 11 has a height of 2.8 mm. Flat faces 111*a*, 111*b* each have a width of 0.23 mm. The thickness of the flat metal plate before forming is 0.8 mm.

Figure 8:
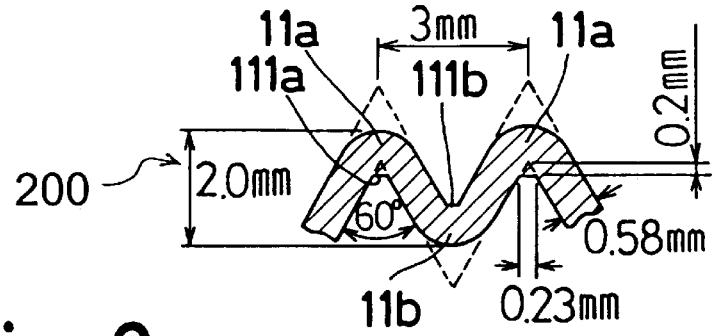
FIG. 8 is a magnified fragmentary view of a third embodiment of the present invention.

A metal plate 200 according to the third embodiment of the invention has the same fundamental structure as the metal plate 10 of the first embodiment, but has dimensional details which differ from the metal plate 10 of the first embodiment. The details of the size of the metal plate of the third embodiment are explained with reference to FIG. 8. The configuration and dimensions of the second, third, fourth, and fifth wave portions of the third embodiment are the same as the first wave portions of the third embodiment.

The third embodiment has a first wave portion 11 with a thickness of 0.58 mm. The pitch of the first wave portion 11 is 3 mm. An interior angle of 60 degrees is defined by the slopes of the first mound portion 11*a* of the first wave portion 11, and an interior angle of 60 degrees is defined by the first valley portion 11*b* of the first wave portion 11. The first wave portion 11 has a height of 2.0 mm. The flat faces 11*a*, 111*b* each have a width of 0.23 mm. The thickness of the flat metal plate before forming is 0.8 mm.

Figure 9:
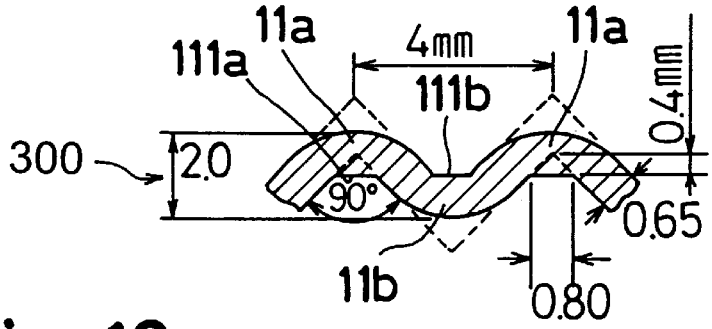
FIG. 9 is a magnified fragmentary view of a fourth embodiment of the present invention.

Metal plate 300, according to the fourth embodiment of the invention, has the same fundamental structure as the metal plate 10 of the first embodiment, but has dimensional details which differ from the metal plate 10 of the first embodiment. The details of the size of the metal plate of the fourth embodiment are explained with reference to FIG. 9. The configuration and dimensions of the second, third, fourth, and fifth wave portions of the fourth embodiment are the same as the first wave portions of the fourth embodiment.

The fourth embodiment of the first wave portion 11 has a thickness of 0.65 mm. The pitch of the first wave portion 11 is 4 mm. An angle defined by the first mound portion 11*a* of the first wave portion 11 is 90° and an angle defined by the first valley portion 11*b* of the first wave portion 11 is 90°. The height of the first wave portion 11 is 2.0 mm. The width of the flat faces 111*a*, 111*b* is 0.80 mm. The thickness of the flat metal plate before forming is 0.8 mm.

Figure 10:
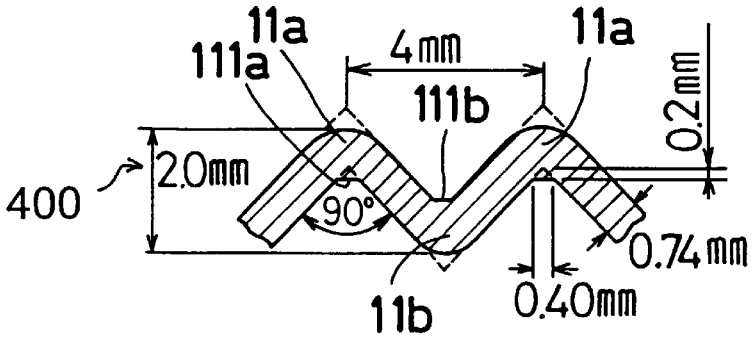
FIG. 10 is a magnified fragmentary view of a fifth embodiment of the present invention.

Metal plate 400 according to the fifth embodiment of the invention has the same fundamental structure as the metal plate 10 of the first embodiment, but has dimensional details which differ from the metal plate 10 of the first embodiment. The details of the size of the metal plate of the fifth embodiment are explained with reference to FIG. 10. The configuration and dimensions of the second, third, fourth, and fifth wave portions of the fifth embodiment are the same as the first wave portions of the fifth embodiment.

The fifth embodiment has a first wave portion 11 with a thickness of 0.74 mm. The pitch of the first wave portion 11 is 4 mm. An internal angle of 90 degrees is defined by the first mound portion 11*a* of the first wave portion 11; and an internal angle of 90 degrees is defined by the first valley portion 11*b* of the first wave portion 11. The first wave portion 11 has a height of 2.0 mm. The flat faces 111*a*, 111*b* each have a width of 0.40 mm. The thickness of the flat metal plate before forming is 0.8 mm.

The hardness of the metal plate according to the described embodiments is measured by using a micro vickers testing machine (not shown).

Figure 11:
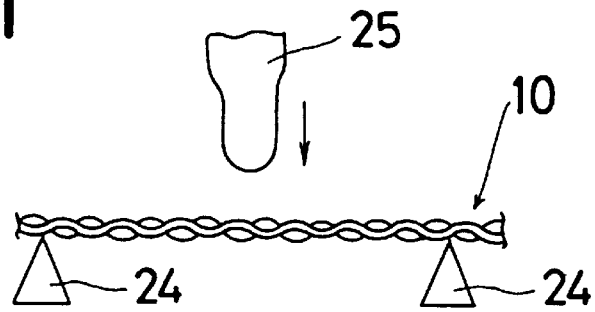
FIG. 11 is an explanatory view showing a method for measuring the bending strength and deflection of a metal plate of high strength and low stiffness according to the present invention.
Figure 12:
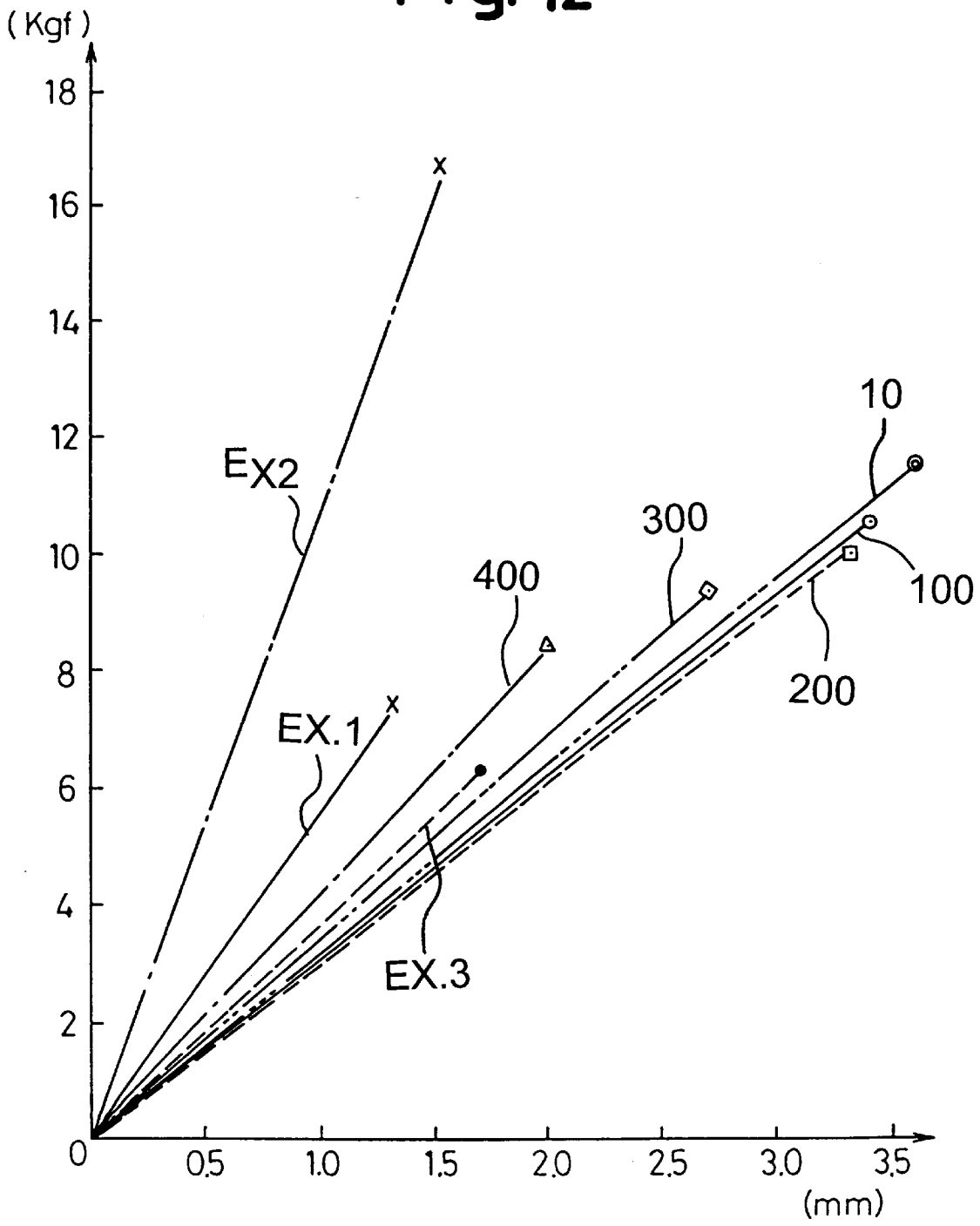
FIG. 12 is a graph showing the relationship between the deflection and the bending force of a metal plate according to the present invention.

The bending strength or resistance, and the deflection of the metal plate according to the embodiments are measured by using a device as shown in FIG. 11. The bending strength or resistance corresponds to the weight of a weight 25 at an elastic limit of the metal plate 10 when the weight 25 is placed on the metal plate 10, which is supported by spaced supporting points 24. Deflection corresponds to the deflection of the metal plate 10 at the elastic limit thereof. The results of the hardness, the bending strength and the deflection of the metal plates are shown in table 1. The results of the bending strength and the deflection of the metal plates are shown in FIG. 12.

Hereinafter, comparisons, which are made for different examples, are described in connection with the description of FIGS. 13 to FIG. 17.

Figure 13:
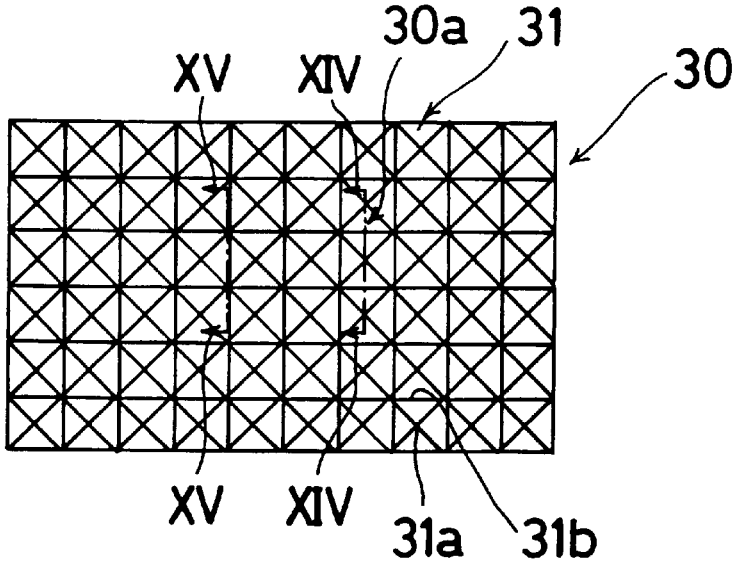
FIG. 13 is a plan view of a metal plate used as a first comparison example.
Figure 14:
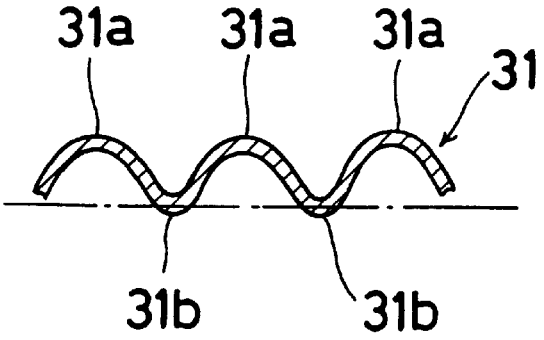
FIG. 14 is an enlarged fragmentary cross-sectional view taken along the section line XIV—XIV in FIG. 13.

As shown in FIG. 13 and FIG. 14 for the first comparison, a metal plate 30 includes a flat portion 30*a* and a plurality of wave portions 31. The flat portion 30*a* corresponds to the flat metal plate before stamping and is a reference face for forming. The wave portions 31 extend parallel to each other in a direction (the up and down direction in FIG. 13).

The wave portions 31 include a plurality of equally spaced mound portions 31*a* and a plurality of equally spaced flat portions 31*b*. The mound portions 31*a* project from one side of the flat portion 30*a* substantially perpendicular to the plane of the metal plate in one thickness direction (the upward direction in FIG. 14). The flat portions 31*b* are located between the two adjacent mound portions 31*a*. The surface and opposite back face of each flat portion 31*b* are equal to the surface and opposite back face of the flat portion 30*a*, respectively.

Figure 15:
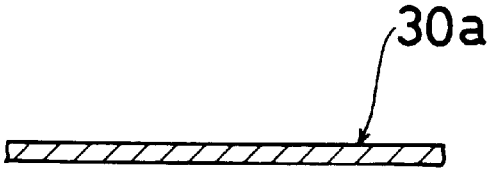
FIG. 15 is an enlarged fragmentary cross sectional view taken along the section line XV—XV in FIG. 13.

As shown in FIG. 15, the shape of a vertical section of the center portion between the two adjacent wave portions 31 corresponds to the shape of a vertical section of the flat portion 30*a*. The center portion is as thin as the flat metal plate 23 before stamping.

The thickness of the wave portion 31 is 0.7 mm. The pitch of the wave portion 31 is 4 mm. An angle defined by the slopes of the mound portion 31*a* of the wave portion 31 is 90°. The height of the wave portion 31 is 1.2 mm. A flat face (not shown) is provided at a back face of the top portion of the mound portion 31*a*. The width of the flat face is 0.40 mm. The thickness of the flat metal plate before die stamping is 0.8 mm.

Figure 16:
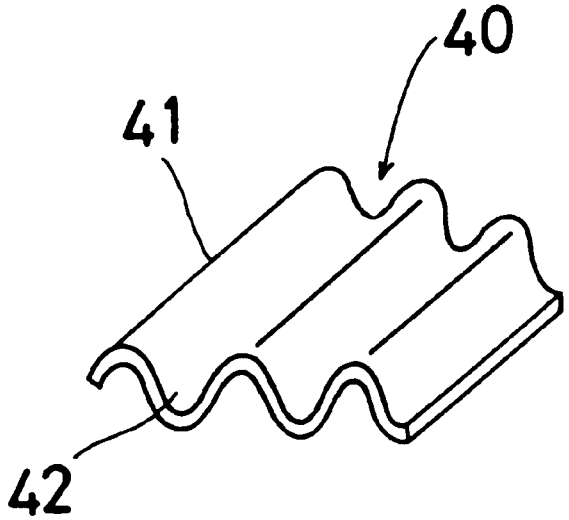
FIG. 16 is a perspective view of a metal plate used as a second comparison example.
Figure 17:
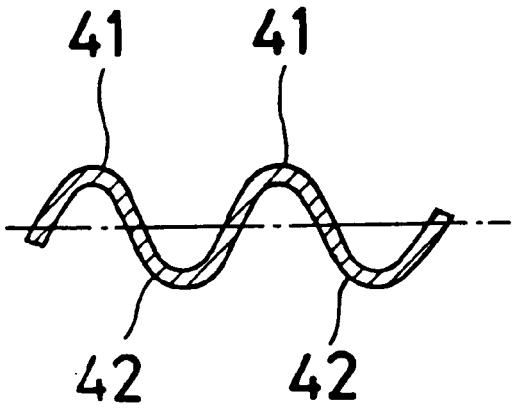
FIG. 17 is an enlarged fragmentary vertical cross-sectional view of FIG. 16.

As shown in FIG. 16 and FIG. 17, a metal plate 40 used as an example for the second comparison is a corrugated sheet having a certain sectional shape. The metal plate 40 includes undulations having a plurality of mound portions 41 and a plurality of valley portions 42 therebetween.

The mound portions 41 extend in a direction parallel to each other and project from the flat metal plate before forming in the upward direction as viewed in FIG. 17. The valley portions 42 are located between the adjacent mound portions 41, and extend in the same direction as the mound portions 41. The valley portions 42 project from the flat metal plate in the direction opposite to the mound portions 41.

The thickness of the metal plate 40 is 0.8 mm. The pitch of the mound portion 41 is 4 mm. An angle defined by the slopes of the mound portion 41 is 90° and an angle defined by the valley portion 42 is 90°. The height of the metal plate 40 is 2.4 mm. A flat face (not shown) is provided at both the back face of the top portion of the mound portion 41 and the surface of the bottom portion of the valley portion 42*a*. The width of the flat face is 0.40 mm. The thickness of the flat metal plate before forming is 0.8 mm.

The thickness of a metal plate used as an example for the third comparison is 0.8 mm. The hardness, bending strength, and deflection of the first, second and third comparison examples are measured by the same method as the metal plate 10 of the first through fifth embodiment. The results are shown in table 1. The results of both bending strength and deflection are also shown in FIG. 12.

TABLE 1

| | Hardness [HV] | Bending Strength [kgf] | Deflection [mm] | Estimate |
|---|---|---|---|---|
| Embodiment 1 | 234 | 11.5 | 3.6 | ◎ |
| Embodiment 2 | 263 | 10.5 | 3.4 | ◎ |
| Embodiment 3 | 234 | 10.0 | 3.3 | ◎ |
| Embodiment 4 | 204 | 9.3 | 2.7 | ○ |
| Embodiment 5 | 201 | 8.4 | 2.0 | ○ |
| Comparison Example 1 | 170 | 7.3 | 1.3 | x |
| Comparison Example 2 | 150 | 16.5 | 1.6 | Δ |
| Comparison Example 3 | 150 | 6.3 | 1.7 | x |

As shown in Table 1 and FIG. 12, the bending strength of the five embodiments are higher than that of the comparison example 3. This is considered to depend on both share effect and work hardening of the metal plate in forming.

Further, the deflection of the first through the fifth embodiment is greater than that of the comparison examples 1 to 3. In other words, the stiffness of the first through the fifth embodiments lower, or the flexibility is greater, than that of the comparison examples 1 to 3. It is considered that the center portion between the adjacent first and second wave portions 11 and 12 has the shape of the vertical section similar to the flat metal plate and also the center portion is hardened by the forging of the plate during formation so that the center portion is thinner than the flat metal plate.

Further, the bending strength or resistance of the metal plate of the first and second embodiments is higher than the metal plate of the third embodiment 3, and is lower in stiffness, or, in other words, higher in flexibility than the metal plate of the third embodiment. It is noted that the first and second waveforms 11 and 12 of the metal plate of the first and second embodiments have greater heights than the metal plate of the third embodiment. Further, the metal plate of the third embodiment is higher in bending strength than the metal plate of the fourth and fifth embodiments, and is lower in or in other words has greater flexibility than the fourth or fifth embodiments. It is considered that the angle defined by the slopes of each of the first and second mound portions 11*a* and 12*a* (the first and second valley portions 11*b*, 12*b*) of the third embodiment is smaller than the corresponding angle of each of the fourth and fifth embodiments, and that the pitch of each of the first and second mound portions 11*a* and 12*a* (or the first and second valley portions 11*b* and 12*b*) of the third embodiment is smaller than the pitch of each of the fourth and fifth embodiments.

Further, the metal plate of the first embodiment is higher in bending strength or resistance than the metal plate of the second embodiment, and is lower in stiffness, or in other words more flexible than the metal plate of the second embodiment. It is considered that the width of each flat face of the first embodiment is greater than the width of each flat face of the second embodiment. Also, the metal plate of the fourth embodiment is higher than the metal plate of the fifth embodiment in bending strength, and is lower in stiffness than the metal plate of the fifth embodiment in stiffness. It is considered that the width of each flat face of the fourth embodiment is greater than the width of each flat face of the fifth embodiment.

In the present invention, an angle defined by the slopes of the first and second mound portions and an angle defined by the slopes of the first and second valley portions are preferably 45° through 90°. If the angles are greater than 90°, the strength of a metal plate may be lower. If the angles are smaller than 45°, each of the mound portions and valley portions may be broken in forging the metal plate.

The distance between the top of the first mound portion and the bottom of the first cavity or valley portion and the distance between the top of the second mound portion and the bottom of the second valley portion are preferably three to four times the thickness of the flat metal plate before die stamping, respectively. If the distances exceed four times the thickness, the stiffness of the metal plate may be higher. If the distances are less than three times, the strength of the metal plate may be lower.

The thickness of the flat metal plate is preferably 0.6 mm to 1.2 mm, and the pitches of each of first and second mound portions and first and second valley portions are preferably 2.0 mm through 6.0 mm, respectively. If the pitches exceed 6.0 mm, the flexibility of the metal plate may be lessened. If the pitches are less than 2.0 mm, the strength of the metal plate may be lower.

A flat face is preferably provided at a back face of the top of each of the first and second mound portions as well as the surface of the bottom of each of first and second valley portions. Hence, the strength and flexibility of the metal plate can be higher.

Figure 21:
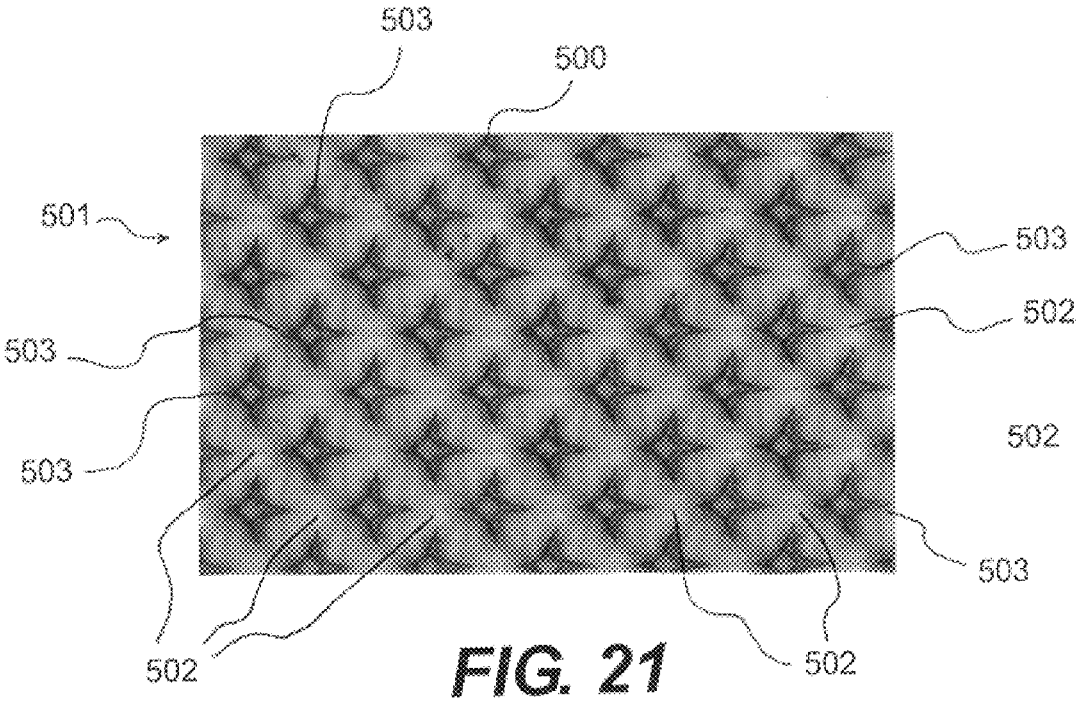
FIG. 21 is a magnified fragmentary photographic view of one surface of a metal plate constructed according to the present invention.
Figure 22:
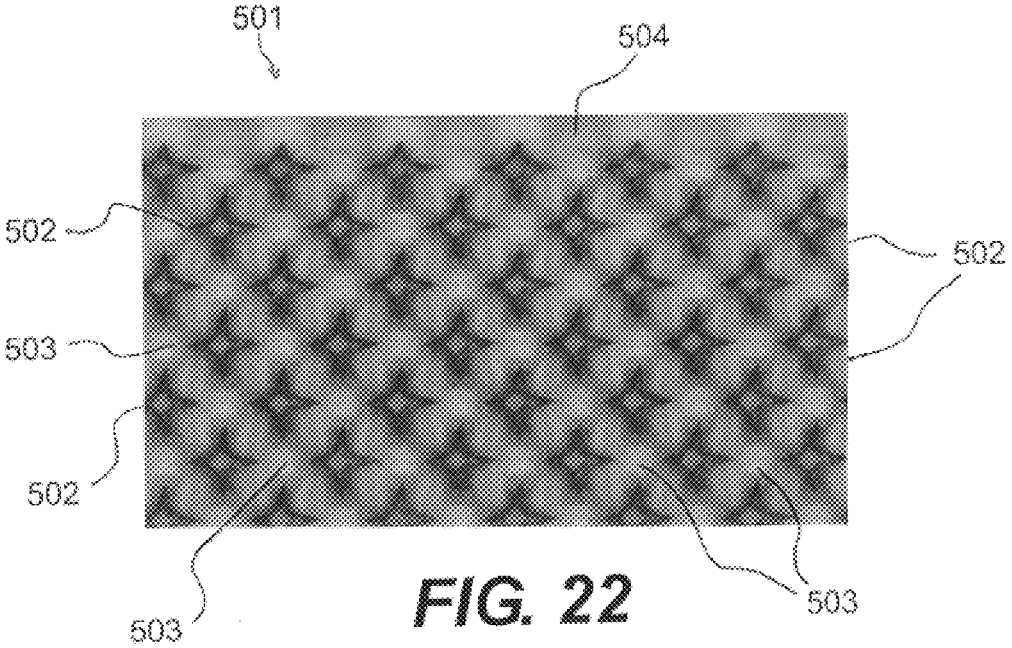
FIG. 22 is a magnified fragmentary photographic view of the surface of the metal plate opposite the surface of FIG. 21 according to the present invention.

Referring to the photograph of FIG. 21, a first side 500 of a metal plate 501 which may correspond in configuration and method of manufacture to any one of the first through the fifth embodiments is illustrated. Hollow protuberances 502 are disclosed that are surrounded by cavities 503. Referring to FIG. 22, the opposite side 504 of the plate 501 is illustrated. Protuberances 502 of FIG. 21 are the hollow portions or cavities of FIG. 22. In both FIGS. 21 and 22, a flat section 505 in elevation similar to FIG. 3 is midway between the protuberances projecting from opposite sides 501 and 504.

Hereinafter a window regulator device 50 to which the metal plate 10 according to the present invention is applied is described in connection with FIG. 18 to FIG. 20.

The window regulator device 50 causes a window glass (not shown) to go up and down relative to a door (not shown) so as to open/close a window (not shown) formed in the door. The window regulator device 50 is located in the door.

Figure 18:
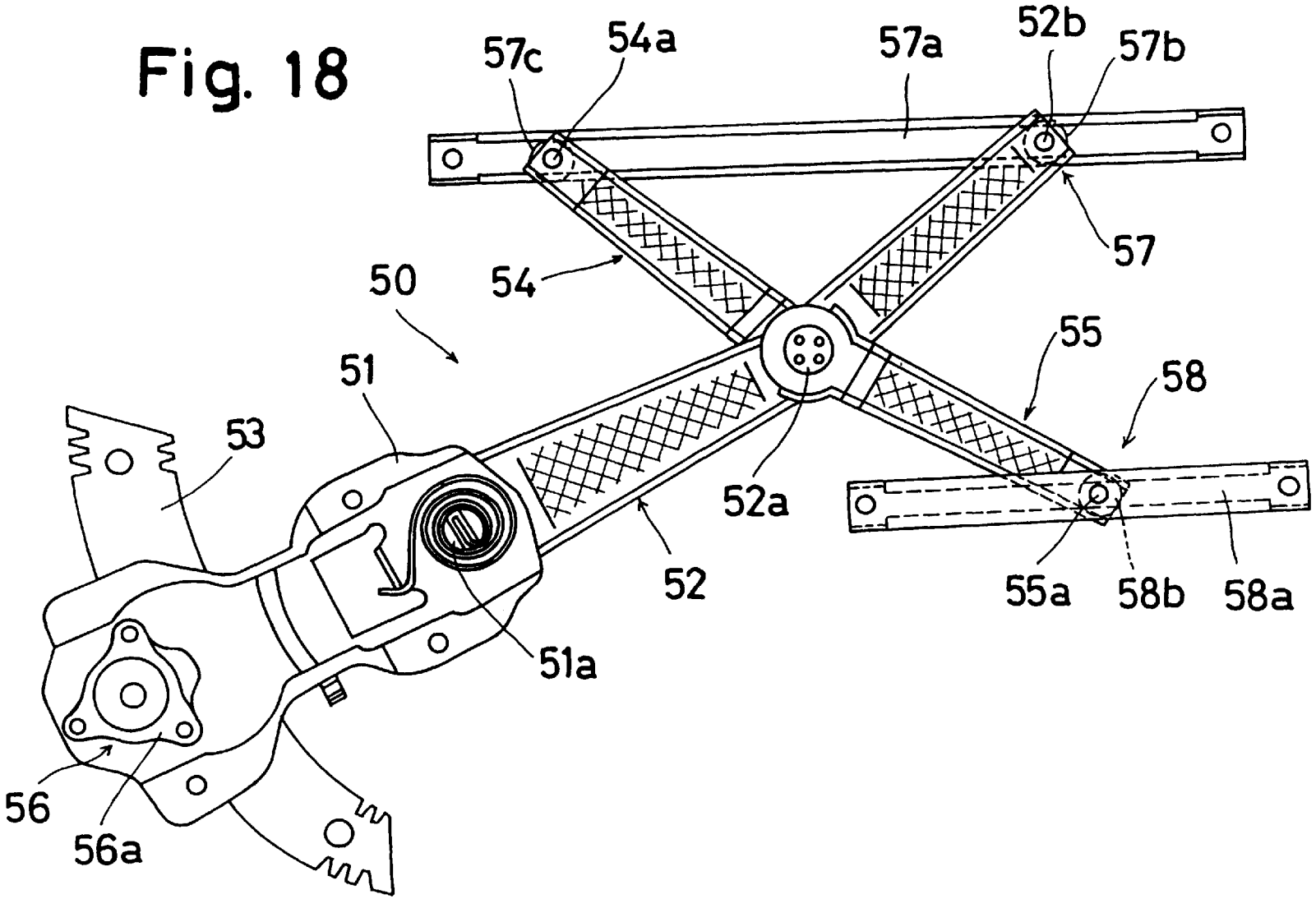
FIG. 18 is a front view of a window regulator device incorporating a metal plate of high strength and low stiffness according to the present invention.

As shown in FIG. 18, the window regulator device 50 includes a base plate 51, a lift arm 52, a driven gear 53, a pair of equalizer arms 54,55, a driving member 56, and a pair of guide members 57,58.

The base plate 51 is fixed to a panel (not shown) of the door. A pin 51*a* is fixed to the base plate 51 and extends in the width direction of a vehicle (not shown).

The lift arm 52 is rotatably supported by a pin 51*a* in a certain plane. One end of the lift arm 52 is fixed to the driven gear 53 and the other end thereof is connected to the window glass through the guide member 57. The driven gear 53 is rotatably supported by the pin 51*a* and has an arcuate configuration.

The equalizer arms 54,55 are rotatably supported by a pin 52*a*. The pin 52*a* is fixed to the lift arm 52 and extends in the width direction of the vehicle. Thereby, the equalizer arms 54, 55 are rotatable relative to the lift arm 52 in the certain plane. The distal end 543 (shown in FIG. 19 ) of the equalizer arm 54 is connected to the window glass through the guide member 57 and the distal end of the equalizer arm 55 is connected to the door through the guide member 58.

The driving member 56 includes a brake member 56 a (e.g., spring coupler) and a pinion gear (not shown). The pinion gear is fixed to an output shaft (not shown) of the brake member 56*a* and is in engagement with the driven gear 53. An operating handle (not shown) is fixed to an input shaft (not shown) of the brake member 56*a*. The driving member 56 may be composed of a motor and a reduction gear in place of the brake member 56*a* and the pinion gear.

The guide member 57 includes a first guide rail 57*a*, a first guide roller 57*b*, and a second guide roller 57*c*. The guide member 58 includes a second guide rail 58*a* and a third guide roller 58*b*.

The first and second guide rails 57*a*, 58*a* include a flange portion bent toward inside so as to have a U-shaped section, respectively. The first and second guide rails 57*a*, 58*a* extend in the lengthwise direction (or in the direction perpendicular to the moving direction of the window glass). The first guide rail 57*a* is fixed to a lower portion of the window glass and the second guide rail 58*a* is fixed to the panel of the door.

The first and second guide rollers 57*b*, 57*c* are slidably guided by the first guide rail 57*a*. The first guide roller 57*b* is rotatably supported by a spherical pin 52*b* fixed to a distal end of the lift arm 52. The second guide roller 57*c* is rotatably supported by a spherical pin 54*a* fixed to the distal end 543 of the equalizer arm 54. The third guide roller 58*b* is slidably guided by the second guide rail 58*a*. The third guide roller 58*b* is rotatably supported by a spherical pin 55*a* fixed to the distal end of the equalizer arm 55. These pins 52*b*, 54*a*, 55*a* may have a shape such as a column.

Both lift arm 52 and equalizer arms 54,55 are formed by the metal plate 10 according to the first embodiment, respectively. Hereinafter, a detailed structure of the equalizer arm 54 is described with reference to FIG. 19 and FIG. 20. Since each of the lift arm 52 and the equalizer arm 55 has the same fundamental structure as the equalizer arm 54, the explanation is omitted.

Figure 19:
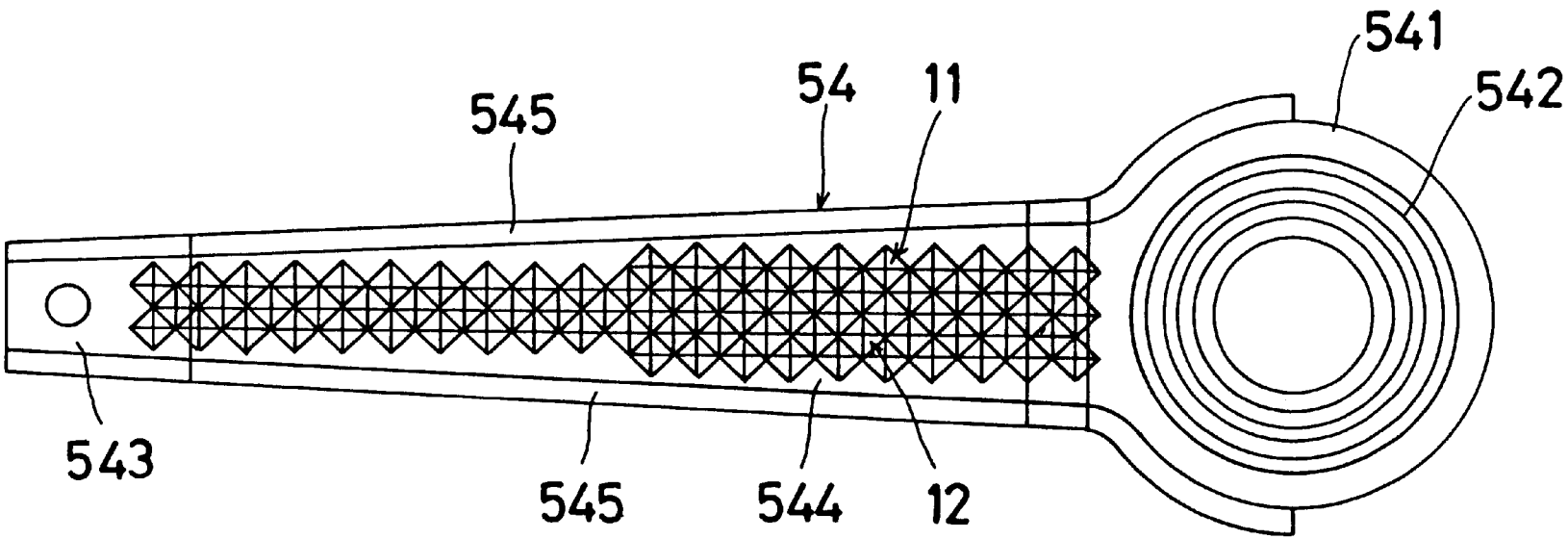
FIG. 19 is a plan view of one of a pair of equalizer arms of FIG. 18.
Figure 20:
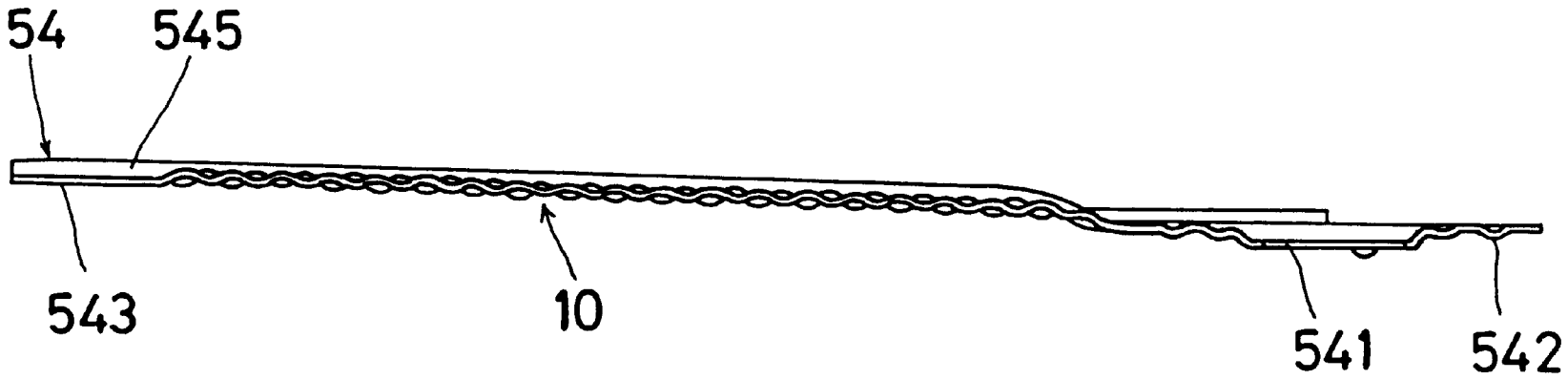
FIG. 20 is a vertical cross-sectional view of one of a pair of equalizer arms in FIG. 19.

As shown in FIG. 19 and in FIG. 20, a plurality of circular ribs 542 are provided on a back face of a base end 541 of the equalizer arm 54 to which the pin 52*a* is fixed, so that the base end 541 has high strength and high stiffness. The first and second wave portions 11,12 according to the first embodiment are integrally formed with a center portion 544 located between the base end 541 and the distal end 543 alternatively, so that the center portion 544 has high strength and flexibility. A flange portion 545 is provided at opposite sides of the equalizer arm 54.

The circular ribs 542 may not be provided on the base end 541. Also, each flange portion 545 may extend to the base end 541 and the height of each flange portion 545 may be higher.

The operation of the window regulator device 50 is now described. If the operating handle is rotated in one direction by a driver, the driven gear 53 rotates in the clockwise direction in FIG. 18 about the pin 51*a*, so that the lift arm 52 rotates about the pin 51*a*. The window glass goes down along the door in three dimension with the first guide rail 57*a*, thereby opening the window.

If the operating handle is rotated in opposite direction by the driver, the driven gear 53 rotates about the pin 51*a*, so that the lift arm 52 rotates in the counterclockwise direction in FIG. 18 about the pin 51*a*. The window glass goes up along the door in three dimensions with the first guide rail 57*a*, thereby closing the window.

In the foregoing operation, the equalizer arms 54, 55 rotates in response to the movement of the first guide rail 57*a* about the pin 52*a*, so that the equalizer arms 54,55 prevent the window glass from rattling. When the rotation of the lift arm 52 is converted to the upward and downward movement of the first guide rail 57*a*, the difference between a path of the lift arm 52 and a path of the first guide rail 57*a* is absorbed by the movement of the first guide roller 57*b*. The difference between a path of the equalizer arm 54 and the path of the first guide rail 57*a* is also absorbed by the movement of the first guide roller 57*b*.

Incidentally, a gap in the width direction of the vehicle between each rotation in the certain plane of both lift arm 52 and equalizer arms 54, 55 and the three dimensional movement of the first guide rail 57*a* (the window glass) is absorbed by the deflection of both lift arm 52 and equalizer arms 54, 55 in the width direction of the vehicle.

In this embodiment, since both lift arm 52 and equalizer arms 54, 55 are formed by the metal plate 10 according to the first embodiment, respectively, the deflections thereof are more than the deflections of both lift arm and equalizer arms formed by the flat metal plate, respectively. Hence, the members 52, 54, 55 can interlock to the three dimensional movement of the window glass when the window glass goes up and down, so that the window glass can move smoothly and it does not generate a noise.

Further, since the strength of both lift arm 52 and equalizer arms 54, 55 is higher than the strength of both lift arm and equalizer arms formed by the flat metal plate, respectively, the members 52, 54, 55 are prevented from being deformed by a force applied to them when the window glass goes up and down.

Further, both lift arm 52 and equalizer arms 54, 55 can be formed by using a low-priced material.

The preferred embodiments described herein are therefore illustrative and not restrictive, the scope of the invention being indicated in the appended claims and all variations and changes, and equivalents thereof, which come within the meaning of the claims are intended to be embraced therein.

What is claimed is:

1. A window regulator device for opening and closing a window, comprising:

a base plate;

driving means mounted on the base plate for driving the window;

a lift arm for engaging at one end with the window, the lift arm being rotatably supported on the base plate and connected to the driving means at another end;

said lift arm having a flat portion with a thickness of 0.6 mm to 1.2 mm and an embossed mid-portion that includes a series of alternating mound and valley portions, the distances between respective adjacent said mound portions and adjacent said valley portions being 2.0 to 6.0 mm; and wherein the thickness of the embossed mid-portion is less than the others portions of the lift arm.

2. A window regulator device according to claim 1 wherein the other portions of the lift arm includes a supporting portion of the lift arm.

3. A window regulator device according to claim 2 wherein the supporting portion has a raised flange.

4. The window regulator device according to claim 2 wherein a center line of the embossed mid-portion of the lift arm in the thickness direction of the lift arm is in the same plane as a center line of the supporting portion of the lift arm in the thickness direction of the lift arm.

5. A window regulatordevice according to claim 1 wherein the embossed mid-portion includes a series of mound portions and valley portions, each mound portion being projected from the lift arm so as form the valley portion on the opposite side of the lift arm.

6. The window regulator device of claim 1 wherein said mound and valley portions are respectively formed by slopping portions that intersect at an angle of 45° to 90°.

7. A window regulator device for opening and closing a window, comprising:

a base plate;

driving means mounted on the base plate for driving the window;

a lift arm for raising or lowering the window, the lift arm being rotatably supported on the base plate and connected to the driving means at one end;

an equalizer arm rotatably mounted on another end of the lift arm;

said equalizer arm having a flat portion with a thickness of 0.6 mm to 1.2 mm and an embossed mid-portion that includes a series of alternating mound portions and valley portions, the distance between respective adjacent said mound portions and adjacent said valley portions being 2.0 to 6.0 mm; and wherein the thickness of the embossed mid-portion is less than the other portions of the equalizer arm.

8. The window regulator device according to claim 7 wherein the other part of the equalizer arm includes a supporting portion of the equalizer arm.

9. The window regulator device according to claim 8 wherein the supporting portion has a raised flange.

10. The window regulator device according to claim 8 wherein the center line of the embossed mid-portion of the lift arm in the thickness direction of the equalizer arm is in the same plane as a center line of the supporting portion of the lift arm in the thickness direction of the equalizer arm.

11. The window regulator device according to claim 7 wherein the embossed mid-portion includes a series of mound portions and valley portions, each mound portion being projected from the equalizer arm so as to form the valley portion on the opposite side of the equalizer arm.

12. The window regulator device of claim 7 wherein said mound and valley portions are respectively formed by slopping portions that intersect at an angle of 45° to 90°.

* * * * *

UNITED STATES PATENT AND TRADEMARK OFFICE

CERTIFICATE OF CORRECTION

PATENT NO.: 6,052,945

DATED: April 25, 2000

INVENTOR(S): Sukekazu ASADA et al.

It is certified that an error appears in the above-identified patent and that said Letters Patent is hereby corrected as shown below:

Claim 5, col. 11, line 19 - "regulatordevice" should read --regulator device--.

Claim 6, col. 11, line 25 - slopping" should read --sloping--.

Claim 12, col. 12, line 30 - "slopping" should read --sloping--.

Signed and Sealed this

Tenth Day of April, 2001

*Attest:*

Nicholas P. Godici

NICHOLAS P. GODICI

*Attesting Officer*

*Acting Director of the United States Patent and Trademark Office*